US010952527B2

(12) United States Patent
Ruiz Rodriguez

(10) Patent No.: US 10,952,527 B2
(45) Date of Patent: Mar. 23, 2021

(54) ROTATABLE BRUSH FOR ANIMALS

(71) Applicant: DELAVAL HOLDING AB, Tumba (SE)

(72) Inventor: Juan-Miguel Ruiz Rodriguez, Tumba (SE)

(73) Assignee: DeLaval Holding AB, Tumba (SE)

( * ) Notice: Subject to any disclaimer, the term of this patent is extended or adjusted under 35 U.S.C. 154(b) by 494 days.

(21) Appl. No.: 15/762,255

(22) PCT Filed: Sep. 23, 2016

(86) PCT No.: PCT/SE2016/050900
§ 371 (c)(1),
(2) Date: Mar. 22, 2018

(87) PCT Pub. No.: WO2017/052460
PCT Pub. Date: Mar. 30, 2017

(65) Prior Publication Data

US 2018/0263366 A1 Sep. 20, 2018

(30) Foreign Application Priority Data

Sep. 23, 2015 (SE) ..... 1551221-3

(51) Int. Cl.
*A46B 13/02* (2006.01)
*A01K 13/00* (2006.01)
(Continued)

(52) U.S. Cl.
CPC ..... *A46B 13/001* (2013.01); *A46B 5/0058* (2013.01); *A46B 9/06* (2013.01);
(Continued)

(58) Field of Classification Search
CPC . A46B 2200/104; A46B 13/02; A46B 13/001; A46B 7/10; A46B 17/06;
(Continued)

(56) References Cited

U.S. PATENT DOCUMENTS 594,732 A 11/1897 Fretwell
6,098,635 A * 8/2000 Marino ..... A46B 13/02 132/238
(Continued)

FOREIGN PATENT DOCUMENTS

DE 10 2004 028 609 A1 1/2006
EP 1 665 927 A2 6/2006
(Continued)

OTHER PUBLICATIONS

Russian Office Action and Search Report for Application No. 2018114692, dated Mar. 18, 2019, with English translation provided.
(Continued)

*Primary Examiner* — Yvonne R Abbott-Lewis
(74) *Attorney, Agent, or Firm* — Nixon & Vanderhye

(57) ABSTRACT

A rotatable brush for animals is provided, having a longitudinal length and including a rotatable core portion with a plurality of bristles each having a first end connected to the core portion and a second free end located in a position radially outwardly of the first end with respect to a rotation axis of the brush. The brush includes at least one protective element rotationally fixedly connected to the core portion. The least one protective element is flexible and extends radially outwardly from the core portion. The protective element forms an outer hair guiding surface portion along the longitudinal length of the brush.

18 Claims, 5 Drawing Sheets

(51) Int. Cl.

| | |
|---|---|
| ***A46B 13/00*** | (2006.01) |
| ***A46B 5/00*** | (2006.01) |
| ***A46B 9/06*** | (2006.01) |
| ***A46B 9/08*** | (2006.01) |
| *A46B 15/00* | (2006.01) |

(52) U.S. Cl.
CPC ..... *A46B 9/08* (2013.01); *A46B 13/02* (2013.01); *A46B 15/0012* (2013.01); *A46B 2200/1093* (2013.01)

(58) Field of Classification Search
CPC ..... A46B 9/08; A46B 2200/1093; A01K 13/002; A01K 13/00
USPC ..... 119/609, 612, 627, 628, 600, 601, 602, 119/608
See application file for complete search history.

(56) References Cited

U.S. PATENT DOCUMENTS

| | | | | |
|---|---|---|---|---|
| 2007/0169720 | A1 | 7/2007 | Roy | |
| 2007/0261187 | A1 | 11/2007 | Dipippo | |
| 2012/0174937 | A1* | 7/2012 | Ragosta | A46B 13/001 132/200 |
| 2016/0330933 | A1 | 11/2016 | Baier | |

FOREIGN PATENT DOCUMENTS

| | | | |
|---|---|---|---|
| EP | 2422617 | | 2/2012 |
| EP | 2 330 887 | B1 | 3/2013 |
| JP | 2003-524469 | A | 8/2003 |
| JP | 2013-530715 | A | 8/2013 |
| WO | 00/69307 | A1 | 11/2000 |
| WO | 2012/005654 | A2 | 1/2012 |
| WO | 2013/176596 | A1 | 11/2013 |
| WO | 2015/110244 | A2 | 7/2015 |

OTHER PUBLICATIONS

International-Type Search Report, dated Apr. 18, 2016, from corresponding PCT application, ITS Request No. ITS/SE15/00217.
International Search Report, dated Dec. 14, 2016, from corresponding PCT application No. PCT/SE2016/050900.
Office Action issued in Japanese Patent Application No. 2018-506980 dated Sep. 28, 2020 with English translation provided.

* cited by examiner

ROTATABLE BRUSH FOR ANIMALS

THE BACKGROUND OF THE INVENTION AND PRIOR ART

The present invention relates to a rotatable brush for animals, having a longitudinal length and comprising a rotatable core portion with a plurality of bristles each having a first end attached to the core portion and a second free end located in a position radially outwardly of the first end with respect to a rotation axis of the brush.

A rotatable brush for animals may be mounted to a support structure, e.g. in a barn or another area where animals are held. The rotatable brush may be driven by an electric motor, either continuously or intermittently when it comes in contact with an animal. The rotatable brush may be cylinder shaped and be provided with bristles which interact with the fur and skin of the animal. The animal is brushed, scratched and/or groomed by the rotating brush. Rotatable brushes are commonly used for short haired animals. There are concerns about the use of rotatable brushes for long haired animals due to the risk that the hair becomes entangled in the brush.

Each of EP 1 665 927 and EP 2 330 887 show an example of a brush arrangement for animals comprising a support arm to which a rotatable brush is connected. The connection between the brush and the support arm is obtained by articulation means suitable for allowing an oscillation of the brush in at least two planes orthogonal to each other. The rotatable brush comprises elongated bristles having a radial extent in relation to a rotation axis of the brush.

SUMMARY OF THE INVENTION

The object of the present invention is to provide a rotatable brush which is also suitable to be used by long haired animals while reducing the risk that the hair becomes entangled in the brush.

This object is achieved by the rotatable brush initially defined, which is characterized in that it comprises at least one protective element rotationally fixedly connected to the core portion, wherein the least one protective element is flexible and is extending radially outwardly from the core portion, and wherein the protective element forms an outer hair guiding surface portion along the longitudinal length of the brush.

When a rotatable brush is used by an animal, a part of the hair strands will inevitably penetrate into spaces between the bristles. The risk that the hair strands get caught in the brush body formed by the bristles and gets wrapped around the rotary core portion increases with the penetration depth of the hair strands into the brush body. The protective element comprises a hair guiding surface rotating together with the bristles at a radial distance from the core portion.

In case a part of a hair strand of an animal penetrates into the brush body to a position located closer to the core portion than the hair guiding surface, the hair guiding surface will rotate, with the rotation of the core portion, and come in contact with the portion of the hair strand located at the same radial distance from the core portion as the hair guiding surface. During the following rotation movement of the hair guiding surface, it will be moved along the hair strand in a direction towards its free end. During this movement, the hair guiding surface moves the part of the hair strand successively radially outwardly to the radial position of the hair guiding surface. In the radial position defined by the protective element, there is little risk that a hair strand becomes entangled in the rotatable brush. Since the hair guiding surface has an extent along the entire longitudinal length of the brush, it will prevent entangling of hair strands along the length of the entire brush.

According to an embodiment of the invention, the protective element is a plate shaped element having an inner edge portion connected to the core portion and an outer free edge portion forming the hair guiding surface portion. Such a protective element has a simple design. The inner edge portion of the plate-shaped protective element can be attached to the core portion by various attachment means. The inner edge of the protective element may e.g. be arranged in a slot or the like of the core portion and/or fixedly attached to the core portion by welding, by an adhesive or by mechanical means. As an alternative to a plate shaped element, the protective element may comprise an elongated element forming the hair guiding surface portion and at least one support element supporting the hair guiding element at a radial distance from the core portion.

According to an embodiment of the invention, the protective element has substantially corresponding mechanical properties as the bristles. Thus the existence of the protective element will not adversely affect the brushing properties of the bristles. The protective element may e.g. be made of a plastic material, a rubber material, a textile material or combinations thereof. Such a protective element can be manufactured at a low cost.

According to an embodiment of the invention, the brush arrangement comprises several protective elements. In certain cases, it is enough with one protective element which moves hair strands radially outwardly once per revolution of the brush. In other cases, several protective elements are preferred. The protective elements may be arranged at regular or irregular intervals around the circumference of core portion. The number of protective elements may e.g. be two, which are arranged at intervals of 180° around the circumference of the core portion, three protective elements which are arranged at intervals of 120° around the circumference of the core portion, or four protective elements which are arranged at intervals of 90° around the circumference of the core portion.

According to an embodiment of the invention, the hair guiding surface is arranged at a constant radial distance from the core portion along its entire extension. In other words, the radial extension of the protective element is constant along the length of the brush, and among one or more protective element arranged around the brush. In case the bristles form a brush body with a cylindrical shape, it is many times suitable to arrange the hair guiding surface at a constant radial distance from the core portion. In cases, when, for example, the bristles form a brush body with a varying diameter around the brush or along the brush, it may be appropriate to arrange the hair guiding surface at a varying radial distance from the core portion.

According to an embodiment of the invention, the hair guiding surface is located at a radial distance from a rotation axis of the brush which is at least twice a radial distance from an outer surface of the core portion to said rotation axis. In this case, it is possible to move the hair strands by the hair guiding surface to a radial position at a relatively long distance from the outer surface of the core portion. The risk that the hair strands become entangled in the brush decreases with an increasing radial distance between the hair guiding surface and the outer surface of the core portion. At the above defined radial distance between the hair guiding surface and the outer surface of the core portion, the risk is low that the hair strands become entangled in the brush.

According to an embodiment of the invention, the hair guiding surface of the protective element is located at a radial distance from the rotation axis which is shorter than a radial distance from the second ends of the bristles to said rotation axis. In this case, the protective elements are more or less covered by the bristles and the existence of the protective elements does not significantly affect the brush properties of the bristles. It is usually enough to move the hair strands radially outwardly to a position relatively close to the periphery of the brush body in order to avoid entangling hair in the brush. However, it is possible to arrange the hair guiding surface of the protective element at the same or at a longer radial distance from the rotation axis as the second ends of the bristles. In this case, the hair strands will be moved radially outwardly by the hair guiding surface to a radial position located at the outer ends of the bristles or even outside the brush body.

In other words, according to one embodiment of the invention the radial extension of the protective element from the core portion is less than the radial extension of the bristles from the core portion. According to another embodiment of the invention the radial extension of the protective element from the core portion is the same as the radial extension of the bristles from the core portion. According to a further embodiment of the invention the radial extension of the protective element from the core portion is longer than the radial extension of the bristles from the core portion. It is advantageous to reduce the depth of hair entering into the body of the brush, i.e. between the bristles of the brush. Thus it may be advantageous to have the one or more protective elements extending as long as possible in the radial direction without being overly exposed to wear etc.

According to an embodiment of the invention the ratio of the radial extension of the protective element from the core portion to the radial extension of the bristles from the core portion is more than 50%, preferably in the range of 80-120%, or more preferably in the range of 90-110%. The ratio of the radial extension of the protective element from the core portion to the radial extension of the bristles from the core portion may be in the range of 80-90% or in the range of 110-120%.

According to an embodiment of the invention, the core portion has a tubular shape. Preferably, the core portion has an outer surface having a circular shape in a plane perpendicular to the rotation axis of the brush. A tubular-shaped core portion comprises an empty inner space which reduces the weight of the brush, but also allows for other components of the brush arrangement to be integrated in the inner space.

According to an embodiment of the invention, the brush is comprised in a brush arrangement. The brush arrangement comprises an electric motor configured to rotate the rotatable brush, a sensor and a control unit configured to receive information from the sensor and to activate the electric motor when an external force acts on the rotatable brush. The sensor may be configured to sensing when an external force acts on the rotatable brush or to detecting the presence of an animal by other means. The sensor may e.g. be arranged to detect a rotation of the brush around its longitudinal axis of rotation, or a deflection or displacement of the brush by means of the external force. Such a brush may thus be rotated by the electrical motor only at periods when an animal is present, subjecting the brush to an external force. Thus, electric energy is saved during periods when the brush is not used. According to one embodiment the electric motor and the sensor may be arranged in the empty inner space of the core portion. The brush arrangement may comprise an electric switch settable in an off position in which no electric energy is supplied to the electric motor and in an on position in which electric energy is supplied to the electric motor when an external force acts on the rotatable brush. It is easy to activate and inactivate the brush arrangement by means of such electric switch. According to another embodiment the electrical motor is arranged at one of the sides of the brush, along the longitudinal axis of rotation of the brush. Preferably the motor is arranged at the side where the brush is supported.

According to an embodiment of the invention, the brush is supported by a support arm attached to a support structure. In this case, the brush can be arranged at a suitable position in a barn or a resting area for animals. The brush arrangement may comprise a hinge arrangement allowing a pivot movement of the brush around two orthogonal pivot axes. In this case, one and the same brush may be operable to abut against substantially all surfaces of an animal in an optimal manner, on the sides and on the back and upper parts of the animal.

BRIEF DESCRIPTION OF THE DRAWINGS

The present invention is now to be explained more closely by means of a preferred embodiment which is disclosed as an example and with reference to the attached drawings.

BRIEF DESCRIPTION OF A PREFERRED EMBODIMENT OF THE INVENTION

Figure 1:
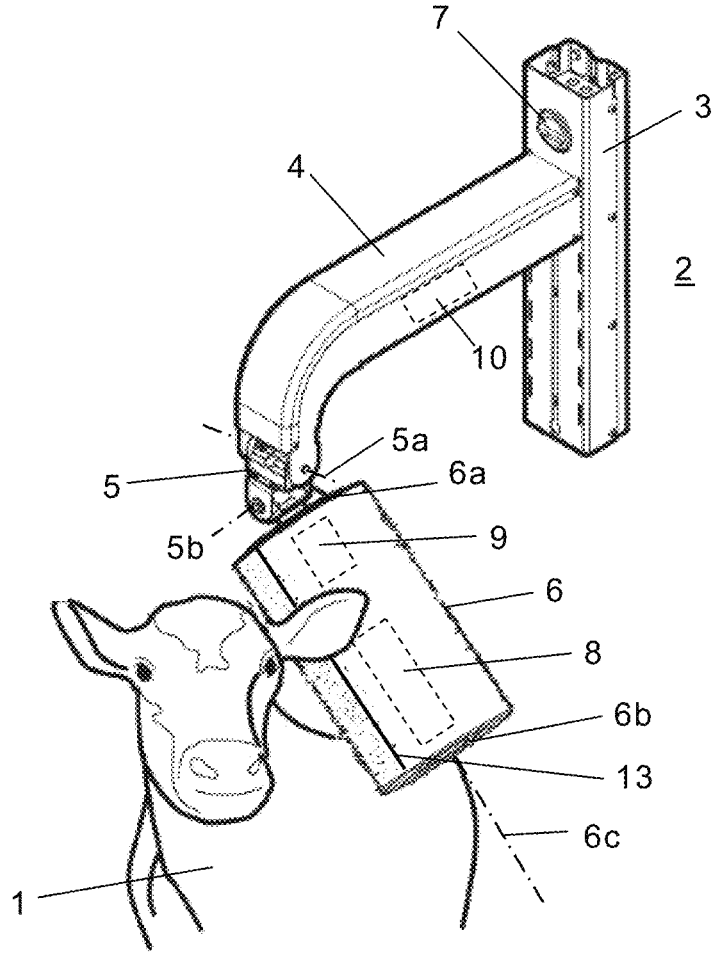
FIG. 1 shows an embodiment of a brush arrangement according to the invention.

FIG. 1 shows a brush arrangement to be used by an animal 1. The brush arrangement comprises a bracket 3 to be attached to a support structure 2 such as a wall, post, beam or the like. The brush arrangement comprises a support arm 4 to be connected to the bracket 3. The support arm 4 comprises a first straight portion having a horizontal extension in a mounted state, a second curved portion and a third short straight portion having a vertical extension in a mounted state. The support arm 4 comprises a first end to be connected to the bracket 3. The support arm 4 comprises a second end to be connected to a cylindrically-shaped brush 6 via a hinge arrangement 5. The brush is provided with at least one protective element 13 as described in more detail further on. The hinge arrangement 5 comprises two orthogonal pivot axes 5*a*, 5*b* allowing a pivot movement of a brush 6 around the pivot axis 5*a*, 5*b* in relation to the support arm 4. The brush 6 has a longitudinal length between a first end 6*a* and a second end 6*b*. The brush 6 hangs vertically downwardly when no external forces act on the brush 6. In this position, the second end 6*b* of the brush is located vertically below the first end 6*a* of the brush 6. The brush 6 is rotationally arranged around a rotation axis 6*c*.

An electric switch 7 is arranged in the bracket 3. The electric switch 7 comprises a rotary knob or button settable in an off position and an on position. A schematically indicated electric motor 8 which drives the brush 6 and a schematically indicated sensor 9 which senses when an external force acts on the brush 6 are arranged in an inner space of the brush 6. A schematically indicated control unit 10 is configured to activate the electric motor 8 when it receives information from the sensor 9 indicating that an external force acts on the brush 6. In the embodiment shown, the control unit 10 is arranged in an inner space of the support arm 4.

Figure 2:
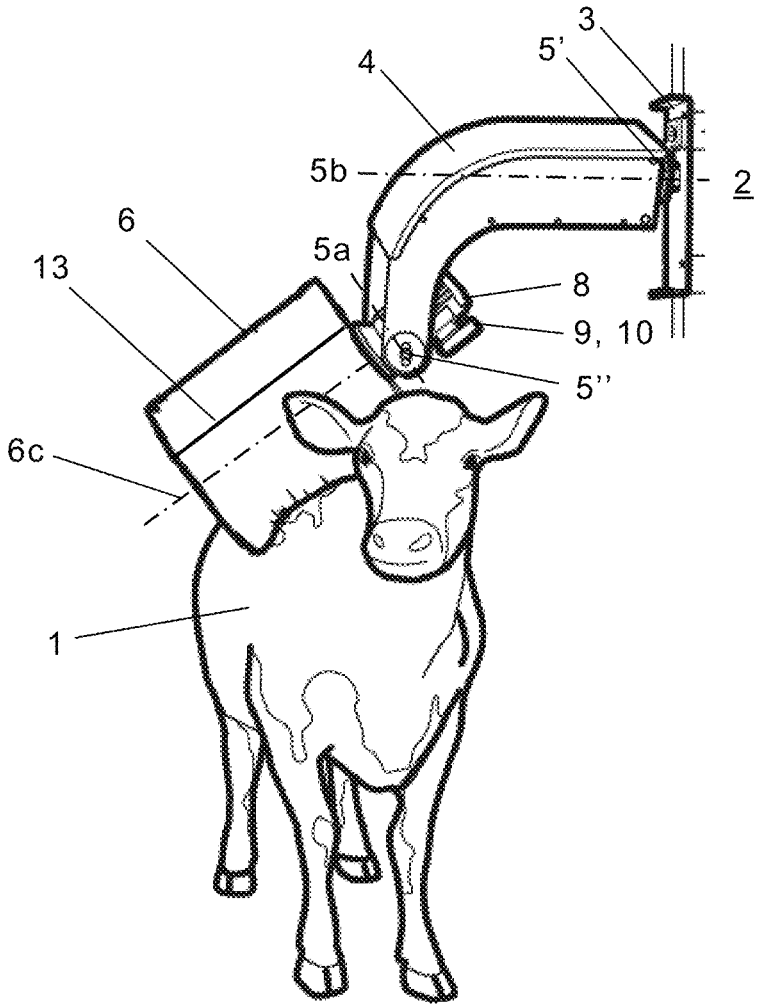
FIG. 2 shows another embodiment of a brush arrangement according to the invention.

FIG. 2 shows another embodiment of a brush arrangement to be used by animals 1. The brush arrangement comprises a bracket 3 to be attached to a support structure 2 such as a wall, post, beam or the like. The brush arrangement comprises a support arm 4 pivotally connected to the bracket 3 by means of a first pivot means 5', such that the support arm is pivotable around a pivot axis 5*b*. The support arm 4 comprises a first straight portion having a horizontal extension in a mounted state, a second curved portion and a third short straight portion. The support arm 4 comprises a first end to be connected to the bracket 3. The support arm 4 comprises a second end to be connected to a cylindrically-shaped brush 6 via a second pivot means 5". The second pivot means 5" allows the brush 6 to pivot about a pivot axes 5*a*, differing from pivot axis 5*b* such as being orthogonal or at least close to orthogonal to the pivot axis 5*b*. Thus in combination, the pivot arrangement 5 comprising the first and second pivot means 5' and 5", allows a pivot movement of the brush 6 around the pivot axis 5*a*, 5*b* in relation to the support 2. The brush 6 has a longitudinal extension between a first and a second end and is rotationally arranged around a rotation axis 6*c* by means of an electric motor 8 which is suspended by the support arm 4 in the second pivot means 5". The rotation of the motor 8 is controlled by means of a control unit 10 connected to a sensor 9. The sensor 9 senses when an external force acts on the brush 6, such as an animal displacing or rotating the brush. The sensor may be e.g. a tilt sensor or a rotation sensor, detecting tiling or rotation of the brush by the external force.

Figure 3:
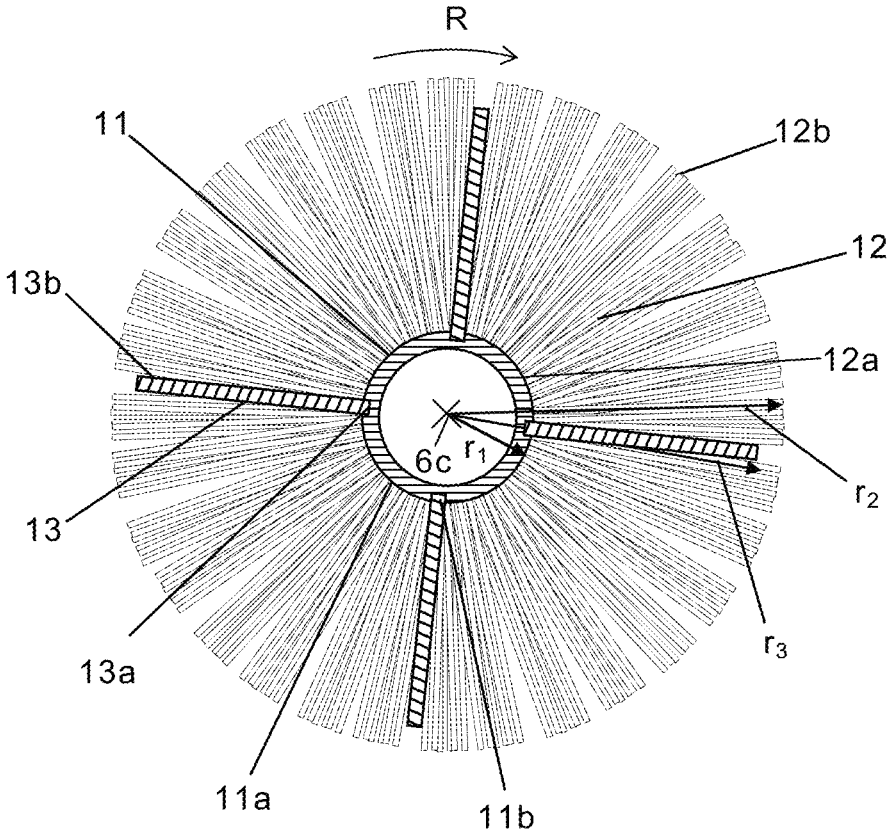
FIG. 3 shows a cross section view of a brush according to a first embodiment of the invention.

FIG. 3 shows a cross section view of a brush 6 according to a first embodiment. The brush 6 comprises a core portion 11 having a tubular shape. The core portion comprises an outer surface 11*a* having a circular shape in a plane perpendicular to the rotation axis 6*c* of the brush 6. The outer surface 11*a* of the core portion 11 is arranged at a first radial distance $r_1$ from the rotation axis 6*c* of the brush 6. The electric motor 8 and the sensor 9 may according to one embodiment be arranged in the inner space of the core portion 11. A plurality of bristles 12 are, at a first end 12*a*, connected to the core portion 11. The bristles 12 have a substantially radial extent from the first end 12*a* to a second free end 12*b*. The second end of the bristles 12*b* is located at a second radial distance $r_2$ from the rotation axis 6*c*.

Figure 4:
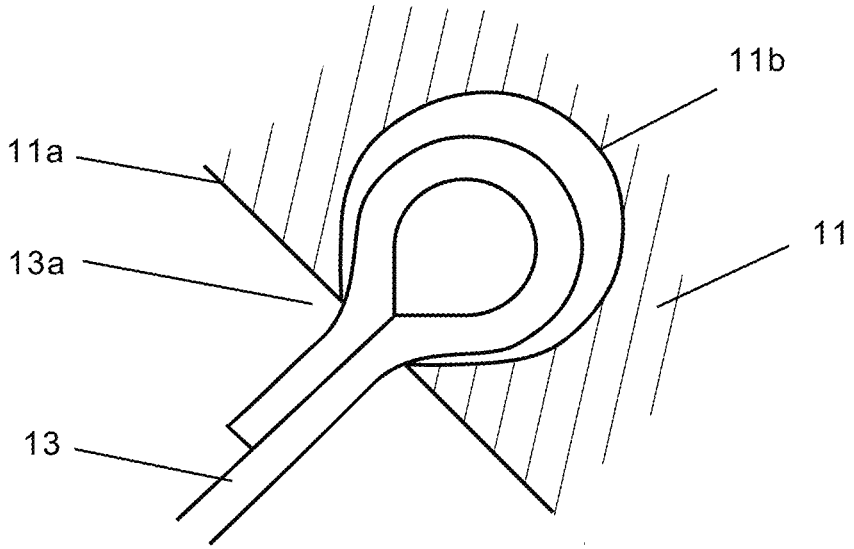
FIG. 4 shows one embodiment of attachment of a protective element to the core portion of the brush.

In the embodiment shown, four flexible protective elements 13 have been attached at regular intervals around the circumference of the core portion 11. Each protective element 13 is plate- or sheet-shaped. Each protective element 13 comprises an inner edge portion 13*a* to be attached to the core portion 11. In the embodiment shown, the inner edge portion 13*a* is attached in a longitudinal slot 11*b* of the core portion 11 by means a suitable attachment means. The attachment means may include fastening by welding, adhesive or mechanical fastening means. As one example the protective element is configured to engage with the core portion to obtain a forms a mechanical attachment. In FIG. 4 one alternative of such a mechanical attachment means is shown in cross-section. The protective element 13 is folded along its length to form a bulge along its inner edge portion 13*a*. The core portion comprises a corresponding longitudinal slot 11*b* in the form of a C-shaped recess along its longitudinal length. The bulge of the protective element is inserted in the recess of the core portion and thus mechanically fastened in the radial direction.

In FIG. 3 the protective elements have a radial extension $r_3$ from the rotation center of the brush and comprises an outer portion forming a hair guiding surface portion 13*b*. The hair guiding surface portion 13*b* is formed at an outer portion of the protective element on the side of the protective element in the direction of rotation R of the brush. Thus the hair guiding surface portion 13*b* may be arranged at the outer portion of the protective element at the third radial distance $r_3$ from the rotation axis 6*c*. The protective elements 13 are attached at regular intervals around the outer surface 11*a* of the core portion 11. The plate shaped protective elements 13 may e.g. be manufactured of a plastic material, a rubber material or a textile material having flexible properties. In the embodiment shown, the protective elements forming the hair guiding surface portions 13*b* have a constant radial extension from the rotation axis 6*c* along the entire longitudinal length of the brush 6. The hair guiding surface portion 13*b* may be located at a third radial distance $r_3$ from a rotation axis 6*c* which is at least twice the first radial distance $r_1$ defined by the outer surface 11*a* of the core portion 11. In the embodiment shown, the hair guiding surface portion 13*b* is located at a third radial distance $r_3$ from the rotation axis 6*c* which is somewhat shorter than the second radial distance $r_2$ defined by the second ends 12*b* of the bristles 12.

Figure 5:
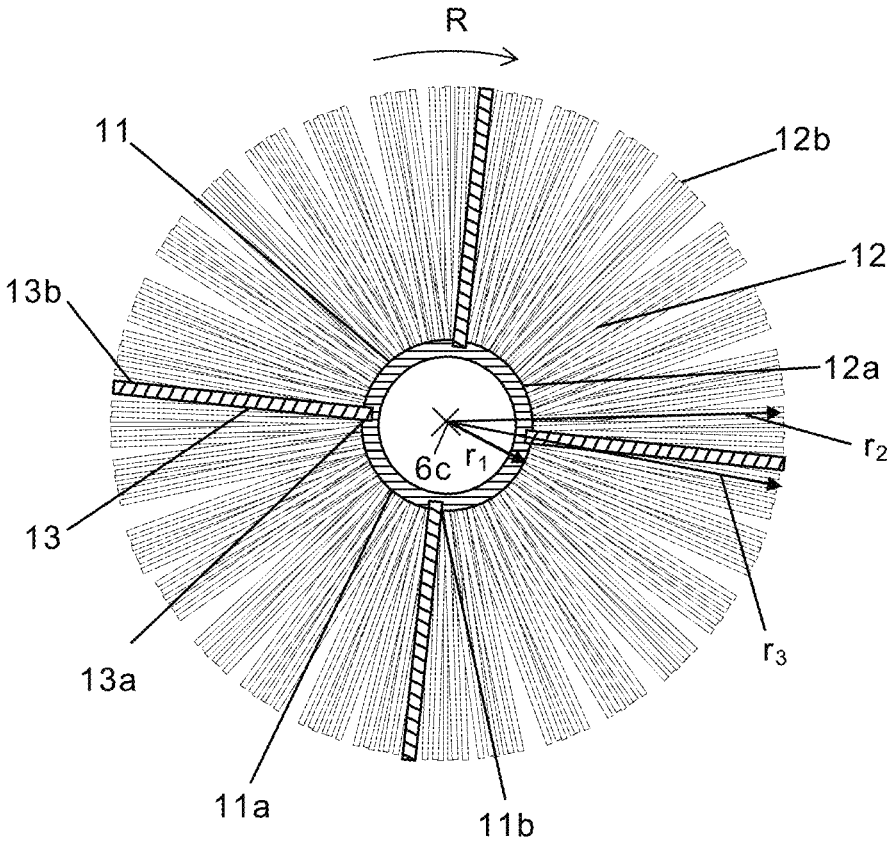
FIG. 5 shows a cross section view of a brush according to a second embodiment of the invention.

In FIG. 5 another embodiment of a brush is shown in cross-section. This embodiment differs from what is shown in FIG. 3 in that the protective element has a radial extension $r_3$ which is similar to, or the same as, the radial extension $r_2$ of surrounding bristles. When the protective band has the same or similar length as the bristles, the hair strands will not penetrate among the bristles next to the protective band.

Figure 6:
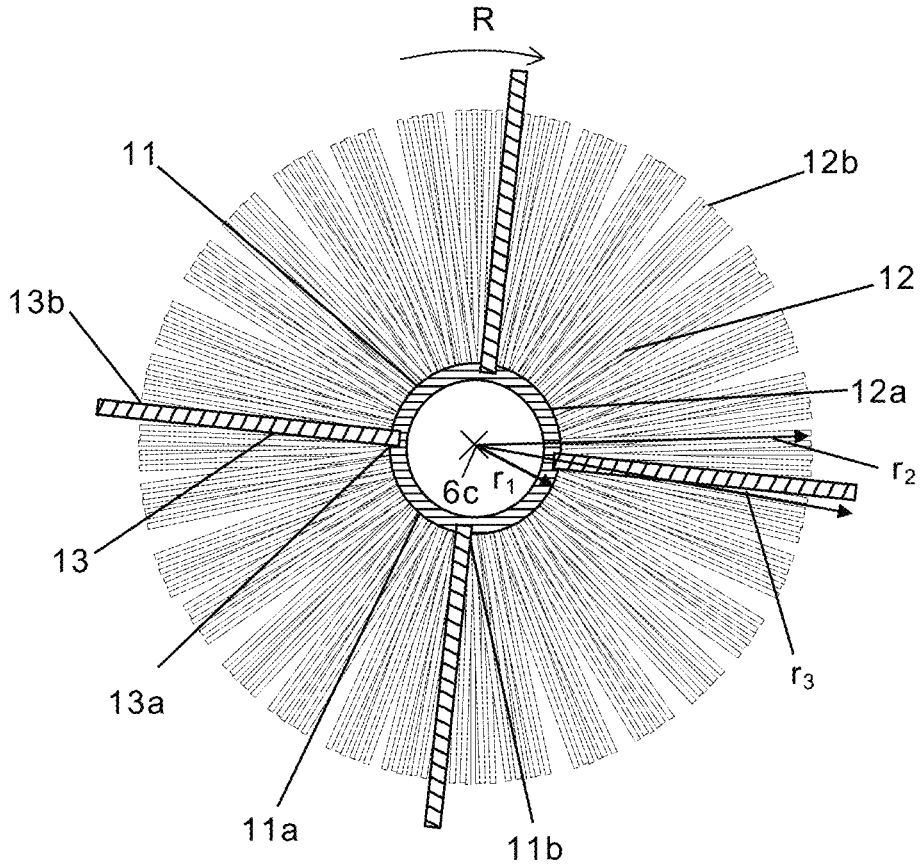
FIG. 6 shows a cross section view of a brush according to a third embodiment of the invention.

In FIG. 6 yet another embodiment of a brush is shown in cross-section. This embodiment differs from what is shown in FIGS. 3 and 5 in that the protective element has a radial extension $r_3$ which is larger than the radial extension $r_2$ of surrounding bristles. Thus the protective elements extend outside the surrounding bristles and the hair guiding surface may also be located at a third radial distance $r_3$ which is longer than the second radial distance $r_2$ defined by the second ends 12*b* of the bristles 12. The longer the radial extension of the protective band, the less the hair strands will be able to penetrate in between the bristles of the brush, but too long and the element will bend over the bristles and may be subjected to wear and possible damage. It is advantageous to have the protective bands a bit shorter to a bit longer than the bristles, in the radial direction.

When an animal provides a pressing force on the brush 6 as described in the examples shown in FIG. 1 or FIG. 2, this is detected by the sensor 9. The sensor sends a signal to the control unit 10 which activates the electric motor 8. The electric motor provides, via suitable movement transmitting members, a rotary movement of the core portion 11. The bristles 12 and the protective elements 13, which are fixedly connected to the core portion 11, provide rotary moments in relation to the animal. At least the second ends 12*b* of the bristles 12 penetrate through the fur of the animals and come in contact with the skin of the animal. As a consequence, the hair strands of the fur will penetrate into the brush body formed by the bristles 12. In case the animal is long haired, the hair strands may penetrate a relatively long distance into the brush body.

The risk that the hair strands get entangled in the brush body is related to the penetration depth of the hair strands into the brush body and also other properties of the hair of the animal, such as how clean it is and how curly the hair is. In the embodiment shown, one of the rotating protective elements 13 comes almost immediately in contact with a hair strand penetrating into the brush body 12. During the following rotation movement of the hair guiding surface portion 13*b*, it will be moved along the hair strand in a direction towards its free end. During this movement, the hair guiding surface portion 13*b* moves the penetrating part of the hair strand successively radially outwardly to the radial position defined by the hair guiding surface portion 13*b*. The third radial distance $r_3$ defined by hair guiding surface portion 13*b* is a predetermined radial distance where the risk that the hair strands will become entangled in the rotary brush 6 is substantially eliminated. This may be at a position close to the outer ends of the bristles. The hair guiding surface portion 13*b* has an extent along the entire longitudinal length of the core portion 11. As a consequence, the protective elements 13 protect against entanglement of hair strands in the entire brush body.

The invention is not restricted to the described embodiment but may be varied freely within the scope of the claims. The numbers of protective elements may, for example, be varied, and the protective elements may be of different lengths or have different lengths along the longitudinal length of the core portion. The brush arrangement may be any type of brush arrangement, and the second radial distance $r_2$ does not need be constant around the whole core portion or along the longitudinal length of the brush.

The invention claimed is:

1. A rotatable brush for animals having a longitudinal length, the brush comprising:

a rotatable core portion;

a plurality of bristles each having a first end connected to the core portion and a second free end located in a position radially outwardly of the first end with respect to a rotation axis of the brush; and at least one protective element rotationally fixedly connected to the core portion, the least one protective element being flexible at least in a direction of rotation of the brush and extending radially outwardly from the core portion, the at least one protective element forming an outer hair guiding surface portion along the longitudinal length of the brush, the at least one protective element having an inner edge portion connected to the core portion and an outer free edge portion forming the hair guiding surface portion, the inner edge portion of the at least one protective element being connected within the core portion, wherein the core portion comprises a slot, and the inner edge portion of the protective element is attached in the slot.

2. The brush according to claim 1, wherein the at least one protective element has a radial extension from the core portion which is approximately the same as a radial extension of the bristles from the core portion.

3. The brush according to claim 1, wherein the at least one protective element has a radial extension from the core portion which is longer than a radial extension of the bristles from the core portion.

4. The brush according to claim 1, wherein the at least one protective element has a radial extension from the core portion which is shorter than a radial extension of the bristles from the core portion.

5. The brush according to claim 4, wherein the at least one protective element has a radial extension from the core portion which is shorter than a radial extension of the bristles from the core portion by no more than a radial distance $r_1$ from an outer surface of the core portion to a rotation axis of the brush.

6. The brush according to claim 1, wherein the slot is a longitudinal slot defined as a C-shaped recess along the longitudinal length of the core portion.

7. The brush according to claim 6, wherein the inner edge portion of the at least one protective element is a folded bulge that is attached in the C-shaped recess.

8. The brush according to claim 1, wherein the at least one protective element is a plate-shaped element.

9. The brush according to claim 1, wherein the at least one protective element is one or more of a plastic material, a rubber material, and a textile material.

10. The brush according to claim 1, wherein the at least one protective element comprises a plurality of protective elements.

11. The brush according to claim 10, wherein the protective elements are disposed at regular intervals around the circumference of the core portion.

12. The brush according to claim 1, wherein the outer hair guiding surface portion is disposed at a constant radial distance from the core portion along an entire longitudinal length of the brush.

13. The brush according to claim 1, wherein the outer hair guiding surface portion is located at a radial distance $r_3$ from a rotation axis of the brush which is at least twice a radial distance $r_1$ from an outer surface of the core portion to the rotation axis.

14. The brush according to claim 1, wherein the core portion has a tubular shape.

15. A brush arrangement comprising:

the rotatable brush according to claim 1;

an electric motor configured to drive the rotatable brush;

a sensor; and a controller configured to activate the electric motor when the controller receives information from the sensor indicating that an external force acts on the brush arrangement.

16. The brush arrangement according to claim 15, further comprising an electric switch which is settable in an off position in which no electric energy is supplied to the electric motor and in an on position in which electric energy is supplied to the electric motor when the external force acts on the brush arrangement.

17. The brush arrangement according to claim 15, wherein the brush is supported by a support arm attached to a support structure.

18. The brush arrangement according to claim 15, further comprising a hinge arrangement allowing a pivot movement of the brush around two orthogonal pivot axes.

* * * * *